US006172650B1

(12) United States Patent
Ogawa et al.

(10) Patent No.: US 6,172,650 B1
(45) Date of Patent: Jan. 9, 2001

(54) ANTENNA SYSTEM

(75) Inventors: Masaru Ogawa; Kunitoshi Nishikawa; Kazuo Sato, all of Aichi-ken (JP)

(73) Assignees: Kabushiki Kaisha Toyota Chuo Kenkyusho, Aichi-gun; Denso Corporation, Kariya, both of (JP)

( * ) Notice: Under 35 U.S.C. 154(b), the term of this patent shall be extended for 0 days.

(21) Appl. No.: 09/343,523

(22) Filed: Jun. 30, 1999

(30) Foreign Application Priority Data

Jul. 2, 1998 (JP) ..... 10-187297

(51) Int. Cl.[7] ..... H01Q 21/00
(52) U.S. Cl. ..... 343/836; 343/761
(58) Field of Search ..... 343/832, 840, 343/834, 839, 836, 837, 790, 793, 794, 803, 761, 781

(56) References Cited

U.S. PATENT DOCUMENTS

| | | | | |
|---|---|---|---|---|
| 3,710,341 | * | 1/1973 | Sciambi, Jr. | 343/779 |
| 3,745,582 | * | 7/1973 | Karikomi et al. | 343/758 |
| 3,866,233 | * | 2/1975 | Schmidt | 343/779 |
| 3,927,408 | * | 12/1975 | Schmidt | 343/779 |
| 4,342,036 | * | 7/1982 | Scott et al. | 343/836 |
| 4,755,826 | * | 7/1988 | Rao | 343/781 P |
| 4,978,967 | * | 12/1990 | Masujima | 343/781 R |

FOREIGN PATENT DOCUMENTS 61-157105 7/1986 (JP) .
6-334423 12/1994 (JP) .

* cited by examiner

*Primary Examiner*—Don Wong
*Assistant Examiner*—Chuc D Tran
(74) *Attorney, Agent, or Firm*—Oblon, Spivak, McClelland, Maier & Neustadt, P.C.

(57) ABSTRACT

There is provided an antenna system applicable to an in-vehicle satellite tracking antenna system. A feed probe (1) is inserted into a ground plate (4) from a lower surface of the ground plate (4) toward an upper surface to protrude from the upper surface. A semicylindrical sub-reflector (2) forming a primary radiator together with the feed probe (1) is arranged on the upper surface of the ground plate (4) in the vicinity of the feed probe (1), and a main reflector (3) is arranged on the ground plate (4) such that mirror surfaces of the reflectors face to each other across the feed probe (1). The main reflector (3) is parabolic in at least one axis, and has a predetermined focal point or a predetermined focal line. The main reflector (3) is standing on the ground plate (4) such that the feed probe (1) is positioned on the focal point or the focal line, which is mounted on the ground plate (4) at a predetermined installing angle θ so that an elevation angle of the antenna is directed in a direction that receives radio waves or a direction that radiates radio waves. Tracking of the antenna system with respect to an azimuth is carried out by turning the ground plate (4) in a fashion being out of contact with the feed probe (1). By virtue of the above construction, the antenna system can be downsized or given a low profile.

21 Claims, 15 Drawing Sheets

ANTENNA SYSTEM

BACKGROUND OF THE INVENTION

1. Field of the Invention

This invention relates to an antenna system, and more particularly to a slimmer or shorter antenna system for receiving microwave band signals, such as satellite broadcasting signals.

2. Description of the Related Art

FIG. 1 shows the construction of a conventional antenna system as known, for example, from Japanese Patent Laid-Open Publication No. Sho61-157105 (JPA Sho61-157105). The antenna system is for use in receiving satellite broadcasting signals and the like, and comprised of a main reflector 12 and a primary radiator 14 which are connected by a supporting arm 26. The main reflector 12 is formed by a belt-type parabolic cylinder which is parabolic horizontally and straight vertically, and has a straight focal line in the vertical direction. The primary radiator 14 formed by a micro-strip line is arranged on the focal line of the parabolic cylinder of the main reflector 12. As shown in FIGS. 2 and 3, according to this antenna system, radio waves transmitted from an artificial satellite are reflected by the main reflector 12, and the reflected radio waves are received by the primary radiator 14 arranged on the focal line, whereby the received electric signals are processed by a high frequency circuit 24 directly connected to the primary radiator 14. The antenna system is set, as shown in FIGS. 1 and 3, such that the parabolic cylinder of the main reflector 12 stands vertically in order to prevent snow accretion when installed outside.

When an antenna system as outlined above is applied to a satellite communication apparatus for moving vehicles, it is desirable that the antenna system assume a low profile in order to preserve appearance, reduce crime risk, and reduce wind resistance when traveling. In this regard, the antenna system shown in FIG. 1, is inconvenient in that the larger the elevation angle of the artificial satellite, the more difficult it is to slim the antenna system. More specifically, the antenna system is constructed such that the directivity thereof in the plane at an elevation angle is directed to the artificial satellite by relatively changing the difference between the height of the main reflector 12 and the height of the primary radiator 14. Therefore, the supporting arm 26 is extended as the elevation angle of the artificial satellite is larger, which inevitably increases the entire height of the antenna system (the total height of the height of the main reflector 12 plus the height of the supporting arm 26).

SUMMARY OF THE INVENTION

It is therefore an object of the invention to provide an antenna system which is slimmer or reduced in height.

It is another object of the invention to provide an antenna system for use, e.g. as tracking antenna system etc. which is simple in construction, inexpensive, and low-profile, without degradation o f its performance.

To attain the above objects, an aspect of the invention provides an antenna system with the advantages described below.

First, an antenna system according to the present invention comprises a ground plate having an upper surface, a feed probe located on the ground plate so as to protrude from the upper surface of the ground plate, a sub-reflector standing on the upper surface of the ground plate in the vicinity of the feed probe, and a main reflector having a mirror surface which has a predetermined focal point or a predetermined focal line, and standing on the upper surface of the ground plate such that the mirror surface of the main reflector and the mirror surface of the sub-reflector face to each other across the feed probe, the focal point or the focal line being determined so as to correspond to a location of the feed probe.

In this construction, component elements arranged on the ground plate are each designed to assume a suitable size or a suitable length and to be arranged at a suitable location on the ground plate. Therefore, the feed probe and the sub-reflector cooperatively function to efficiently radiate radio waves only to the main reflector, or the main reflector functions to radiate radio waves directly to the feed probe or by way of the sub-reflector. As a result of matching of impedance obtained in a wide frequency band, a highly efficient antenna system is realized. In addition, by virtue of an effect of mirror image caused by the ground plate, the height of the antenna can be reduced to one half of a conventional antenna. In the ground plate of the present invention, only at least its surface in an area sufficient for manifesting the effect of mirror image should be constituted by a conductive material. For example, the ground plate itself may be composed of a plastic material such as polycarbonate, and a thin conductive layer may be formed on its relevant surface.

Another antenna system according to the present invention comprises a plane ground plate having an upper surface, a lower surface, and a hole, a feed probe inserted into the ground plate from the lower surface through the hole so as to protrude from the upper surface of the ground plate in a fashion being out of contact with the ground plate, a sub-reflector standing on the upper surface of the ground plate in the vicinity of the feed probe protruding from the upper surface of the ground plate, and a main reflector having a mirror surface which has a predetermined focal point or a predetermined focal line, and standing on the upper surface such that the mirror surface of the main reflector and the mirror surface of the sub-reflector face to each other across the feed probe, the focal point or the focal line being determined so as to correspond to a location of the feed probe.

According to another aspect of the invention, the ground plate can be turned around the feed probe being a rotational axis in a fashion being out of contact with the feed probe. Further, by turning the ground plate in a fashion being out of contact with the feed probe, the antenna block can be directed in a direction that receives radio waves or a direction that radiates radio waves with respect to an azimuth.

Because the feed probe does not contact with the ground plate, when, for example, the ground plate is turned with the feed probe being the rotational axis in the azimuth direction, it is unnecessary that a distribution line which feeds electric power to the feed probe be turned. This, in turn, dispenses with component elements, such as a rotary joint for allowing the distribution line to perform rotary motion, leading to contribution to reduction of manufacturing cost of the antenna system. Further, it is not necessary to mount a high frequency circuit on the ground plate, and therefore a mechanism for driving the ground plate for rotation can be simplified and downsized. Still further, the directivity in the elevation angle of the antenna block is set by determining an installing angle $\theta$ of the main reflector to a desired value, and hence a separate mechanism for adjusting the elevation angle can be eliminated, which is advantageous in slimming of the antenna system.

According to another aspect of the invention, at least a periphery area around said hole in said upper surface is conductive, and an inner surface area of said hole extending from said upper surface to said lower surface by a length equal to approximately ¼ a wavelength is conductive.

Further, in the above antenna system according to the invention, the hole formed in the ground plate may have a periphery thereof provided with a circular conductor member extending from the upper surface to the lower surface by a length equal to approximately ¼ a wavelength, the circular conductor member having a hollow portion formed therein, the feed probe being inserted into the hollow portion. By providing the conductive inner surface at the hole area or the circular conductor member, even if the feed probe and the ground plate are kept from contact with each other, radio waves can be prevented from leaking to the lower surface of the ground plate, to thereby improve the efficiency of the antenna system.

According to any of the above antenna systems of the present invention, the feed probe may be a sleeve dipole antenna element formed by a coaxial line comprising a central conductor and an external conductor, the external conductor having a sleeve thereof folded by a length equal to approximately ¼ a wavelength, at the end of the coaxial line, the central conductor having a linear conductor extending therefrom by a length equal to approximately ¼ the wavelength away from the end.

In this manner, when the sleeve dipole antenna element and the ground plate are used in combination and at the same time, the feed point of an antenna element is placed above the upper surface of the ground plate, the same characteristic as that obtained by a two-element linear array used as a primary radiator to be formed by the feed probe and the sub-reflector can be obtained through the mirror image effect of the ground plate, whereby the directivity of the antenna in the horizontal direction can be enhanced. As a result, especially when the height of the main reflector is reduced, unnecessary radio waves radiated over the main reflector can be reduced, leading to high efficiency of the antenna system.

Further, according to any of the above antenna systems of the invention, the main reflector stands on the upper surface of the ground plate at an installing angle depending on an elevation angle and in a direction that receives radio waves or a direction that radiates radio waves. By virtue of this construction, the directivity of the antenna in the elevation angle direction can be adjusted by determining the installing angle θ of the main reflector with respect to the ground plate to a desired value. As a result, the thickness of the antenna system, which is determined by the height of the main reflector, can be slimmed down, and therefore a lower-profile antenna system can be realized. In addition, when the elevation angle is adjusted, change in position of the whole antenna system is not required, leading to a system with a lower profile.

Still further, according to the invention, when the width of directional beams is expanded in the direction of the elevation angle by setting the height of the main reflector to be lower, the antenna system need not carry out tracking of an artificial satellite in the direction of the elevation angle. On the other hand, when the main reflector is formed of a belt-type offset parabola having a focal point at a location of the feed probe, the width of directional beams in the plane at the elevation angle can be narrowed, to thereby obtain higher peak gain.

According to a further aspect of the invention, the ground plate forms a turn table which is disposed on the base stand via the bearing in a rotatable manner, the ground plate being turned around the feed probe being a rotational axis, by transferring rotation of a motor to the periphery portion of the ground plate.

In this aspect, there are arranged only a required minimum number of component elements (e.g. the main reflector and the sub-reflector) on the ground plate, and the feed probe and the ground plate are kept out of contact with each other. Therefore, the distribution line to the feed probe is simplified, leading to the light-weight ground plate. As a result, the ground plate is rotated by a simple mechanism, and hence a small-sized motor can be used in driving the ground plate for rotation.

According to a still further aspect of the invention, the ground plate is of a disk type and turned around the feed probe being a rotational axis, by supporting the periphery of the ground plate by the guides in a rotatable manner, and by transferring rotation of the motor arranged on the base stand to the periphery portion of the ground plate.

In this manner, when the ground plate is supported by the guides and driven by the motor for turn, it can be turned by means of an extremely simple structure without using the bearing which is more expensive as the size thereof becomes larger, to thereby realize a simplified antenna system for tracking an artificial satellite.

According to a still further aspect of the invention, the upper surface of the ground plate includes an area surrounded by the mirror surface of the sub-reflector and the mirror surface of the main reflector facing the same at least the area on the upper surface functioning as the reflection surface that manifests the effect of mirror image.

When at least the area on the upper surface of the ground plate surrounded by the sub-reflector and the main reflector serves as the reflection surface, sufficient function can be performed as the ground plate of the present invention. In this connection, to obtain the reflection surface of the ground plate for manifesting the effect of mirror image, the area on the plate upper surface should be made conductive.

The main reflector having a focal point or the focal line is formed by a rotational paraboloid mirror having a focal point or a parabolic cylinder mirror having a focal line.

The above and other objects, features and advantages of the invention will be more apparent from the following detailed description taken in conjunction with the accompanying drawings.

DESCRIPTION OF THE PREFERRED EMBODIMENTS

The present invention will now be described in detail with reference to the drawings illustrating various aspects of the preferred embodiment.

[Aspect 1]

Figure 6:
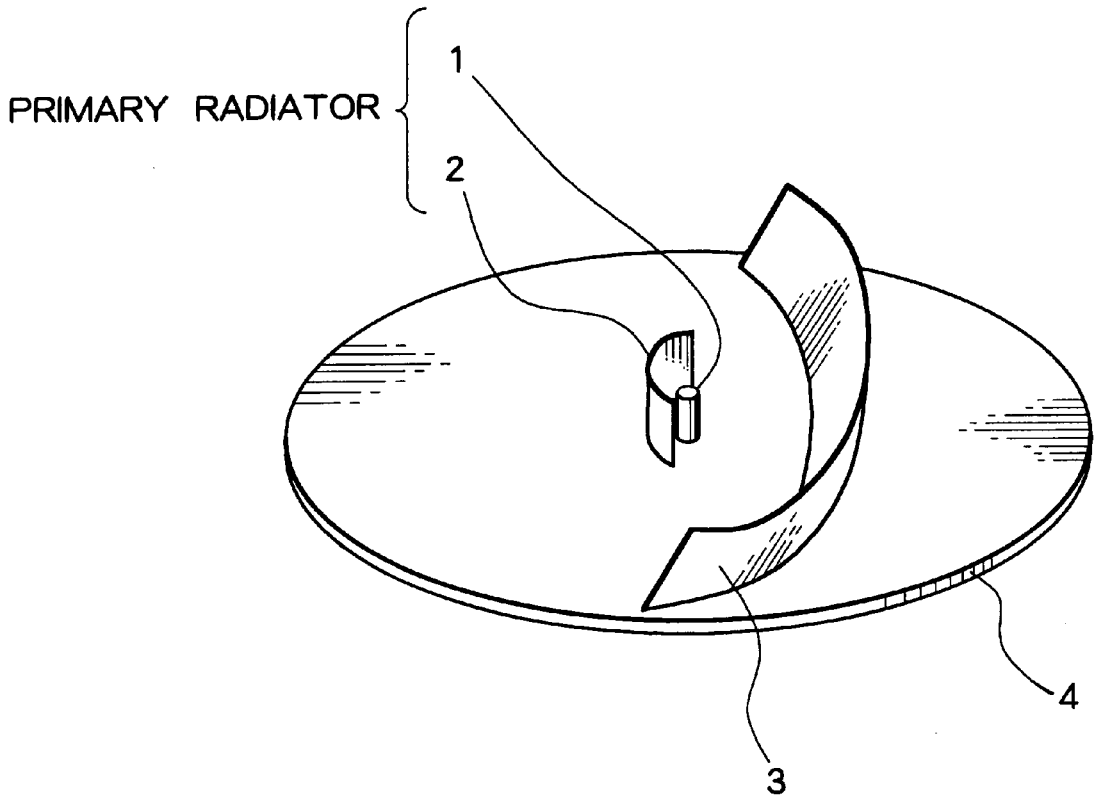
FIG. 6 is a perspective view showing the construction of an antenna system according to an Aspect 1 of a preferred embodiment of the present invention.
Figure 7:
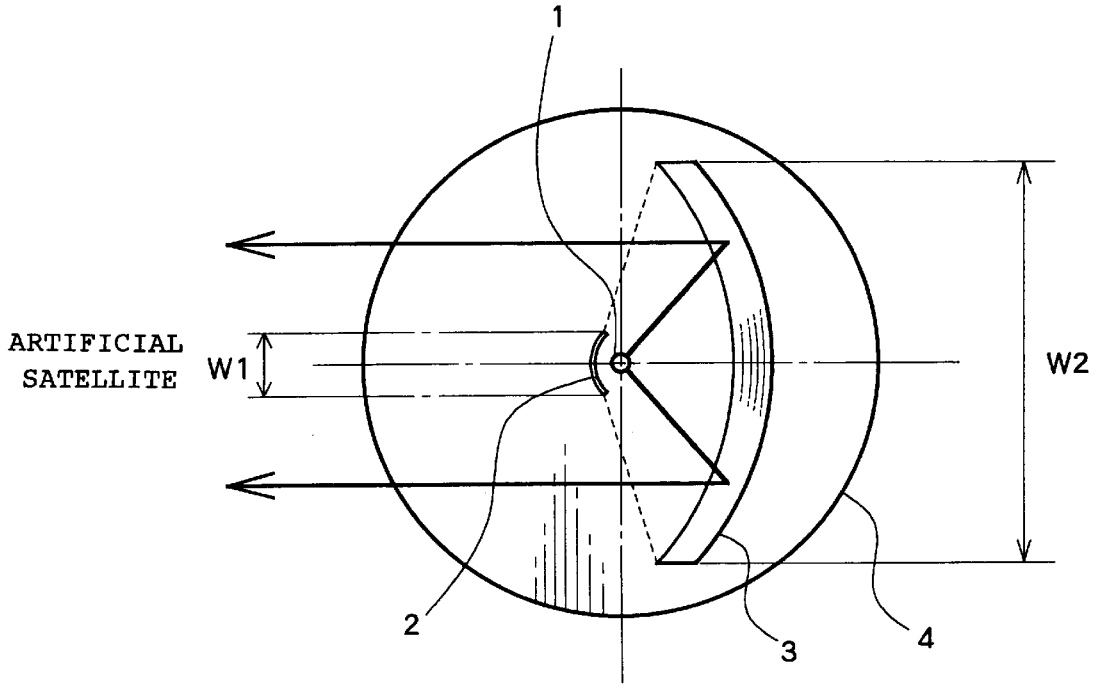
FIG. 7 is a schematic plan view of the antenna system of FIG. 6.
Figure 8:
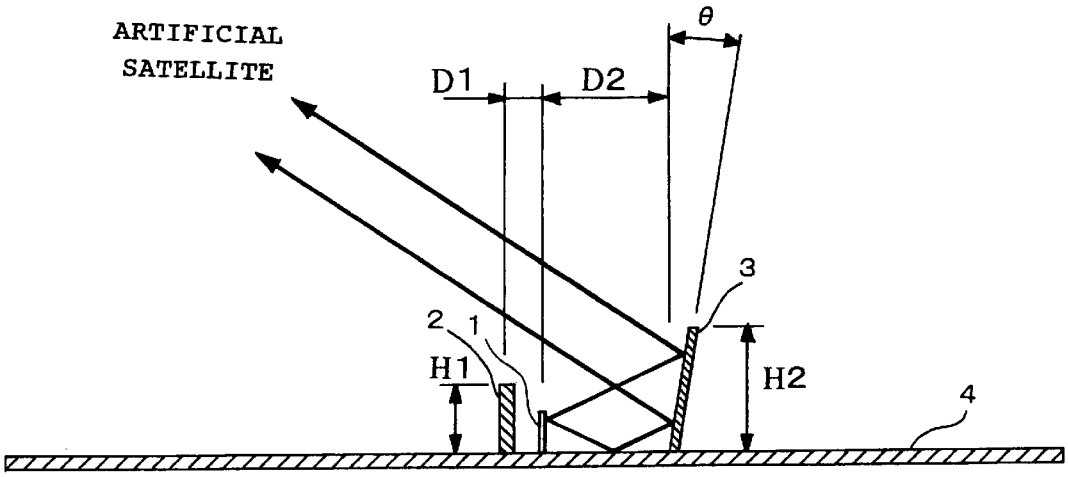
FIG. 8 is a schematic cross sectional view of the antenna system of FIG. 6.

Referring first to FIG. 6, there is schematically illustrated the construction of an antenna system according to an Aspect 1 of the preferred embodiment of the present invention. FIG. 7 is a plan view of the antenna system, and FIG. 8 is a cross sectional view of the significant portions of the antenna system. The antenna system is applied, for example, to an in-vehicle satellite tracking antenna which functions both as a transmitting antenna and a receiving antenna. In the following description, a transmission antenna system will be described for simplicity of description.

The antenna system in Aspect 1 is comprised of a linear feed probe 1, a sub-reflector 2, a main reflector 3, and a disk-type ground plate 4. The feed probe 1 is inserted into the ground plate 4 from a lower surface of the ground plate 4, to thereby protrude from an upper surface of the ground plate 1. The upper surface functions as a reflection surface. Arranged on the upper surface of the ground plate 4 are the sub-reflector 2 and the main reflector 3 in a facing relation across the feed probe 1. The main reflector 3 is formed by a belt-type parabolic cylinder having a predetermined focal line, and parabolic horizontally and straight vertically. The main reflector 3 is spaced a distance D2 away from the feed probe 1 so that the feed probe 1 is placed on the focal line. The sub-reflector 2 forms a semicylinder and is installed in the vicinity of the feed probe 1 such that mirror surfaces of the main reflector 3 and the sub-reflector 2 face each other across the feed probe 1. The sub-reflector 2 is spaced a distance D1 away from the feed probe 1.

In the present aspect of the preferred embodiment, a primary radiator of the antenna system is comprised of the ground plate 4, the linear feed probe 1, and the sub-reflector 2, and a mono-pole antenna is composed by inserting the linear feed probe 1 into the ground plate 4 from the lower surface thereof. The mono-pole antenna is omnidirectional in a horizontal plane. Therefore, by arranging the sub-reflector 2 close to the feed probe 1 such that the sub-reflector 2 is opposed to the main reflector 3 across the feed probe 1, and by optimizing the sub-reflector 2 with respect to a width W1 thereof in the horizontal plane (see FIG. 7) and with respect to a height H1 in the vertical direction (see FIG. 8), radio waves transmitted from the feed probe 1 to the sub-reflector 2 are reflected by the sub-reflector 2, whereby the radio waves can be efficiently radiated to the main reflector 3.

Specifically, the primary radiator in Aspect 1 has a construction such that the feed probe has a length equal to ¼ the wavelength which corresponds to the resonance wavelength, and therefore, by adjusting the distance D1 between the feed probe 1 and the sub-reflector 2, matching of impedance can be obtained over a wide band.

In the antenna system in Aspect 1, the ground plate is sufficiently large in diameter with respect to the wavelength and at the same time the main reflector is arranged on the ground plate. Therefore, scattering of radio waves caused by the edge of the ground plate 4 can be eliminated, which can lower the elevation angle of directional beams of the primary radiator. As a result, useless radiation of radio waves over the main reflector 3 is reduced, so that even if the height of the main reflector is reduced to make the antenna system low-profile, the efficiency of the antenna can be prevented from degradation.

In this regard, in the present Aspect 1, it is sufficient if at least an area on the upper surface surrounded by the mirror surface of the sub-reflector 2 and the mirror surface of the main reflector 3 facing the same, indicated by the dotted lines in FIG. 7, functions as the reflection surface. On the other hand, to prevent scattering of radio waves, it is preferable that an area outside the area defined by the dotted, lines each connecting between an end of the sub-reflector 2 and an end of the main reflector 3, should function as well as the reflection surface, to thereby manifest the effect of mirror image. Furthermore, the ground plate may be composed of a conductive plastic material. In this case, the mirror image effect can be obtained without providing a separate thin conductive layer on the upper surface of the ground plate.

Further, the main reflector 3 can be inclined at a predetermined installing angle θ with respect to a vertical line to the horizontal plane of the ground plate 4 (plane of the ground plate 4). By virtue of this inclination, even if the antenna system does not assume a high profile, setting of the installing angle θ depending on the elevation angle of the artificial satellite can easily lead directional beams in the direction of an artificial satellite.

Figure 1:
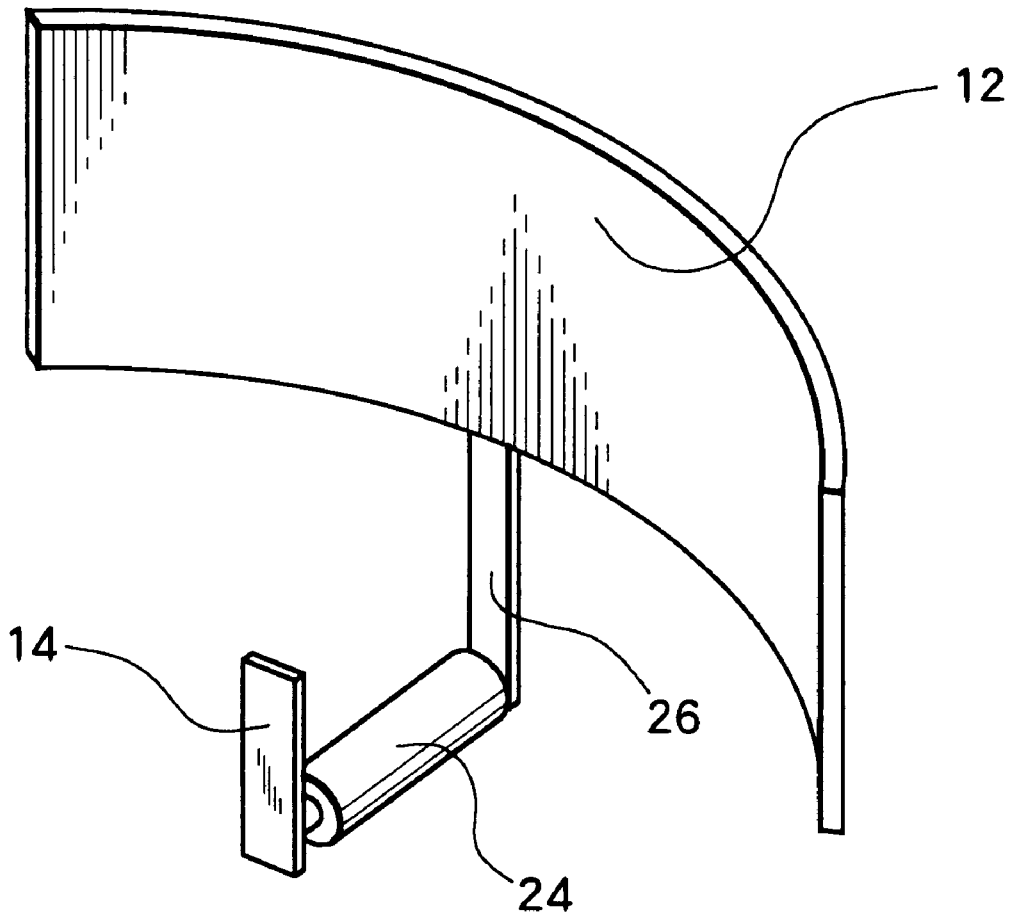
FIG. 1 PRIOR ART
FIG. 1 is a perspective view showing the construction of a conventional antenna system.
Figure 2:
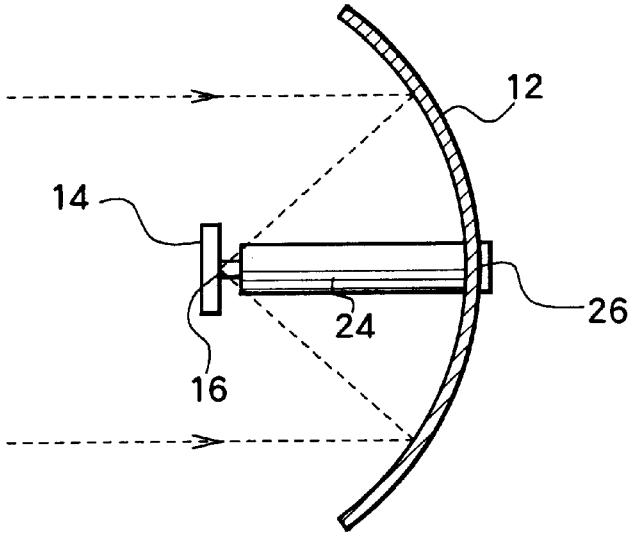
FIG. 2 PRIOR ART
FIG. 2 is a plan view of the antenna system of FIG. 1.
Figure 3:
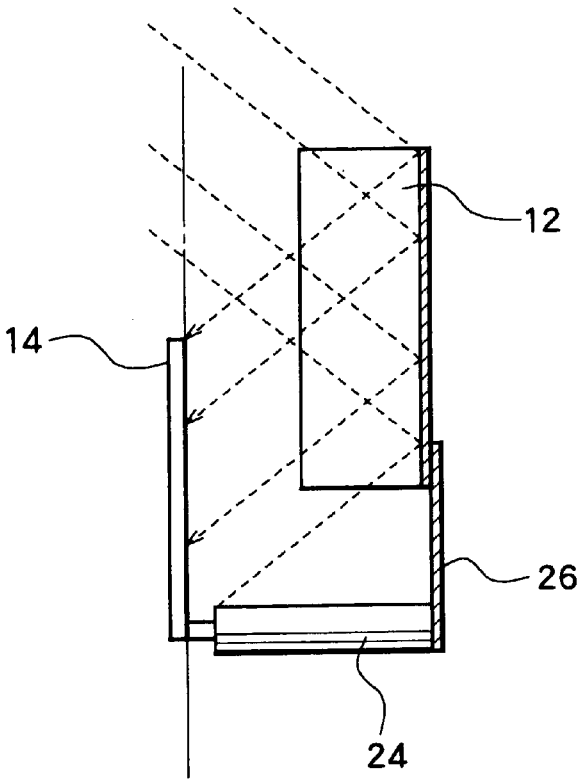
FIG. 3 PRIOR ART
FIG. 3 is a longitudinal cross sectional view of the antenna system of FIG. 1.
Figure 9:
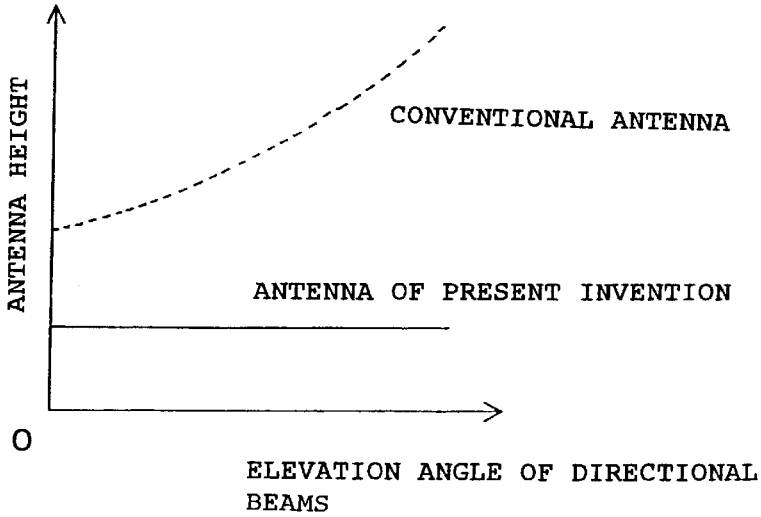
FIG. 9 is a graph showing the relationship between the height of the antenna system and the elevation angle of directional beams.

According to the antenna system of Aspect 1, the entire height of the antenna system is almost equal to the height of the main reflector 3. While in the conventional antenna system as shown in FIG. 1, increase in the elevation angle of directional beams inevitably leads to increase in the height of the antenna, according to the antenna system in Aspect 1, as shown in FIG. 9, increase in the elevation angle of directional beams can be dealt with merely by adjusting the installing angle θ of the main reflector 3, and therefore the height of the antenna need not be increased. In addition, where θ=0, if the height of the antenna is reduced to even one half of the height of the system shown in FIG. 1, the same directivity can be obtained by an effect of mirror image caused by the ground plate. Therefore, an extremely low profile antenna system can be formed.

Gain of the antenna system and directional beam width can be set to desired values by adjusting, respectively, the width W1 and the height H1 of the sub-reflector 2 or a width W2 and a height H2 of the main reflector 3. If the height H2 of the main reflector 3 is low, the directional beam width in a plane at the elevation angle is expanded, resulting in decreased gain. To overcome this inconvenience, according to the antenna system in Aspect 1, as shown in FIG. 7, the main reflector 3 is formed into a horizontally parabolic cylinder to thereby direct horizontally spread directional beams. As a result, even if an aperture area is reduced due to the low profile of the antenna system, decrease in the gain can be suppressed.

By virtue of the above construction, the antenna system in Aspect 1 can be configured with a low profile, but with excellent performance and only slight decrease in gain despite that low profile. As a result, a low-profile antenna suitable for installation in vehicles can be realized.

Figure 10:
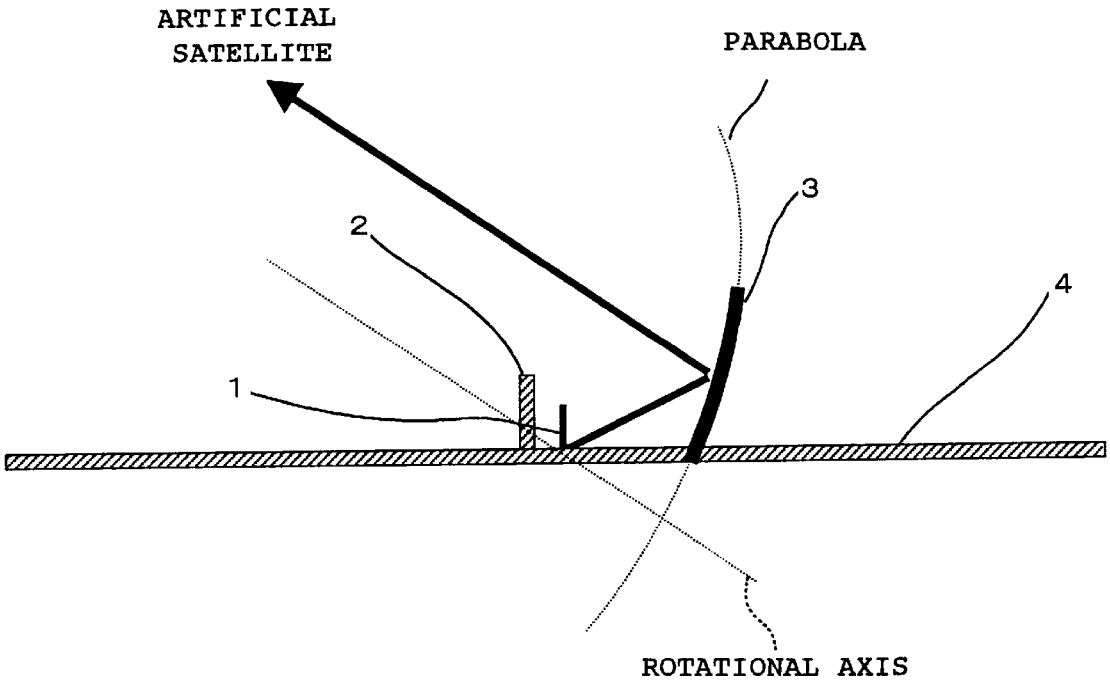
FIG. 10 is a cross sectional view schematically showing the construction of an antenna system according to a variation of Aspect 1.

The above described antenna system employs the main reflector 3 which is horizontally parabolic and vertically straight, but the present invention is not limited in this way. Alternatively, the main reflector 3 may be formed by a belt-type rotational parabolic cylinder (offset parabola), as shown in FIG. 10, which has a focal point at a location of the feed probe 1 and a rotational axis indicated by the dotted line in the figure. If a wave source of the primary radiator can be assumed as a point source, higher peak gain can be obtained by the main reflector 3 of the rotational parabolic cylinder shown in FIG. 10 than by the parabolic main reflector 3 shown in FIG. 6. This leads to improved sensitivity.

[Aspect 2]

Figure 11:
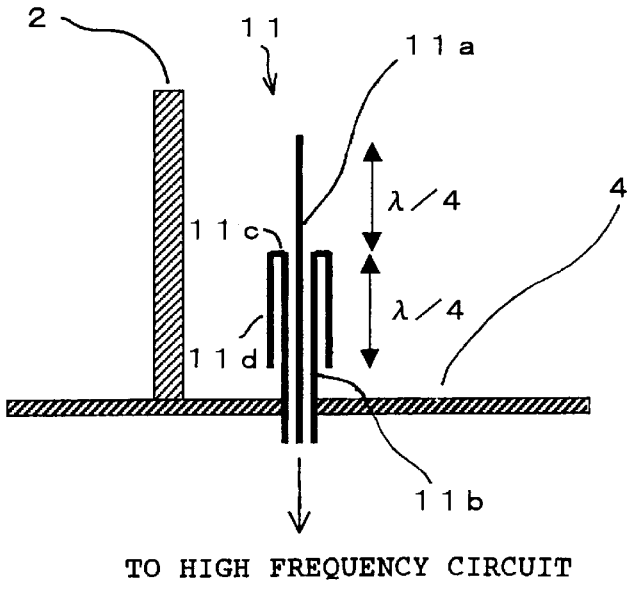
FIG. 11 is a cross sectional view schematically showing the construction of a primary radiator of an antenna system according to an Aspect 2 of the preferred embodiment of the present invention.

According to an antenna system in a further Aspect 2 of the preferred embodiment of the present invention, a sleeve dipole antenna element 11 as shown in FIG. 11 is employed as a feed probe in place of the feed probe 1 of Aspect 1. In this Aspect 2, the feed probe 11 in FIG. 11, formed by a coaxial line, is comprised of a central conductor 11*a* and an external conductor 11*b*. The coaxial line has an end, and a sleeve 11*d* of the external conductor 11*b* is folded by approximately ¼ the wavelength λ to be used, at the end, while a linear conductor extending from the central conductor 11*a* protrudes from the end by approximately ¼ the wavelength λ to be used. The linear conductor may be the extended central conductor per se. or another conductor connected to the same. In the above described construction, by arranging as appropriate the location of the sleeve dipole antenna element 11 (feed point) with respect to the ground plate 4 and the sub-reflector 2, matching of impedance can be obtained in a wide frequency band, similarly to the antenna system in Aspect 1. The construction and arrangement of component elements (main reflector) other than the primary radiator are identical to Aspect 1.

Figure 12:
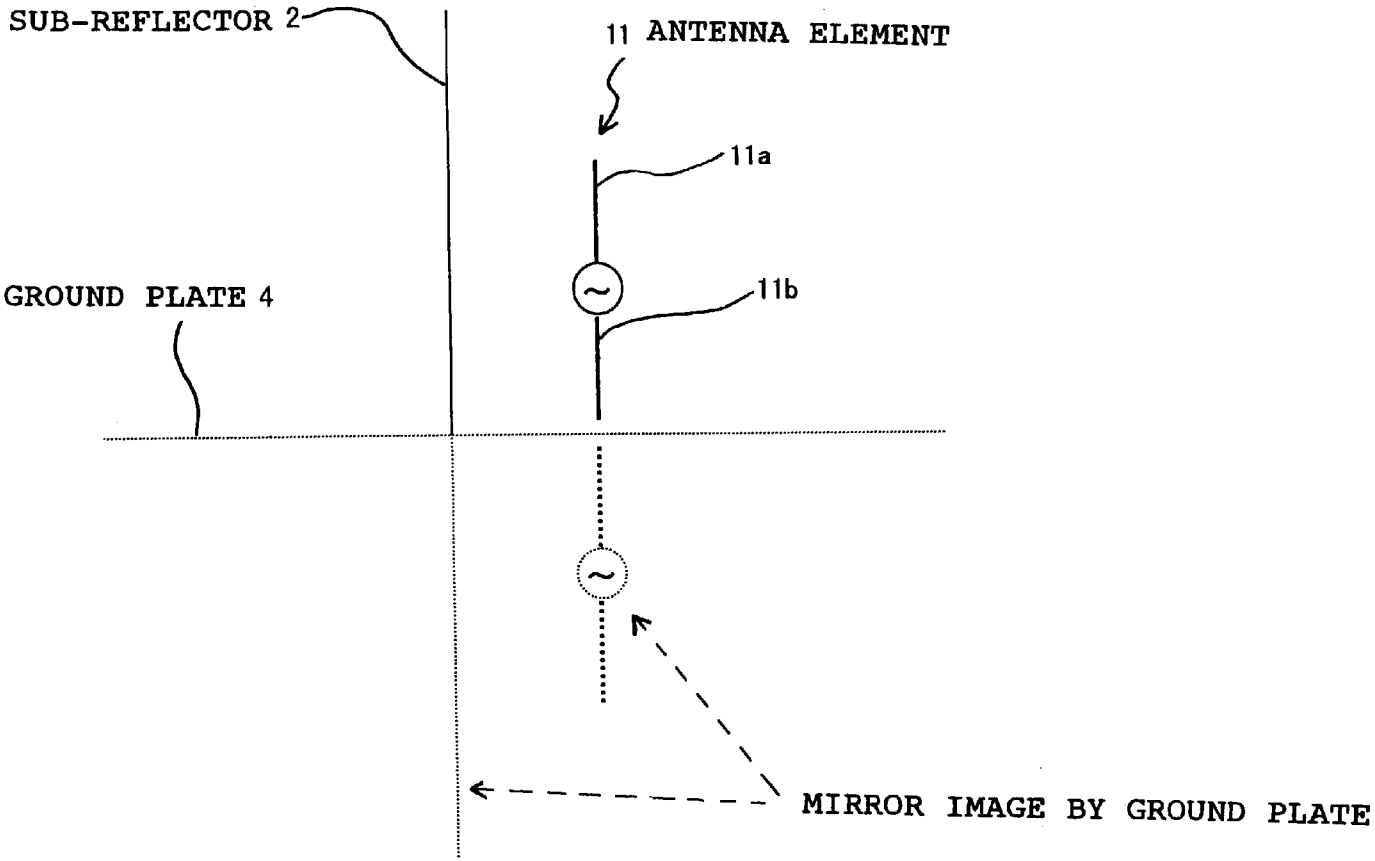
FIG. 12 is a conceptual representation useful in explaining the operation of the antenna system of Aspect 2.

In the mono-pole primary radiator equipped with the ground plate 4, as in Aspect 1, the width of directional beam is relatively wide. Further, in the case that the height of the main reflector 3 is not so high that radiation of radio waves over the main reflector 3 cannot be completely prevented, resulting in slightly degraded antenna efficiency. On the other hand, a discrete sleeve dipole antenna functions without the ground plate, which exhibits the same directivity as that of the mono-pole antenna equipped with the ground plate. Therefore, if the sleeve dipole antenna element 11 and the ground plate 4 are used in combination, as shown in FIG. 11, and at the same time the feed point of the antenna element 11 is upward separated from the ground plate 4, the same characteristic as that obtained by a two-element linear array as the primary radiator can be brought about, as conceptually shown in FIG. 12, by the effect of mirror image caused by the ground plate 4. As a result, the directivity of the antenna in the horizontal direction can be intensified. The feed point of the sleeve dipole antenna element is set to a location (11*c*) at which the sleeve 11*d* of the coaxial line is folded.

In Aspect 2, the combination of the antenna element 11 and the ground plate 4 leads to intensification of the directivity in the horizontal direction. Accordingly, when the main reflector with a reduced height (H2) is employed, the antenna system in Aspect 2 can obtain higher gain than the antenna system in Aspect 1 provided that conditions other than the height (H2) are the same. Therefore, the antenna system in the present aspect can be a more preferable low-profile antenna system.

[Aspect 3]

According to an Aspect 3 of the invention, the construction of a tracking antenna system such as an in-vehicle satellite tracking antenna will be described, which employs the antenna system described in Aspect 1 as an antenna block which is controllable in a rotatable manner with respect to an azimuth.

Figure 4:
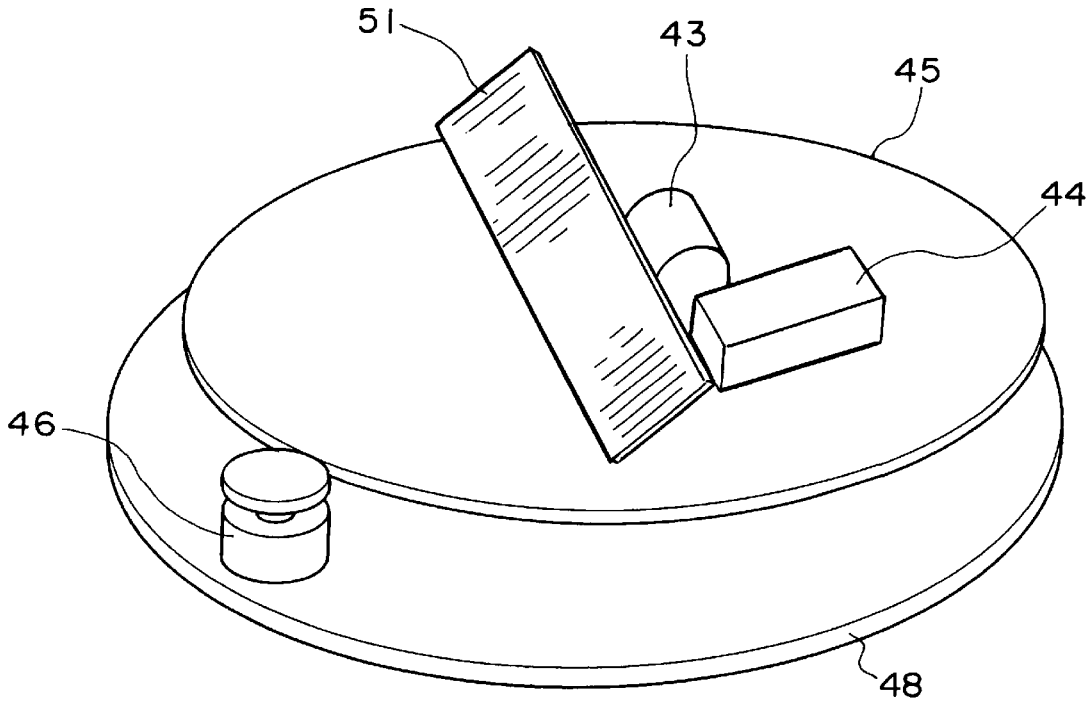
FIG. 4 is a perspective view showing the construction of a tracking antenna system.
Figure 5:
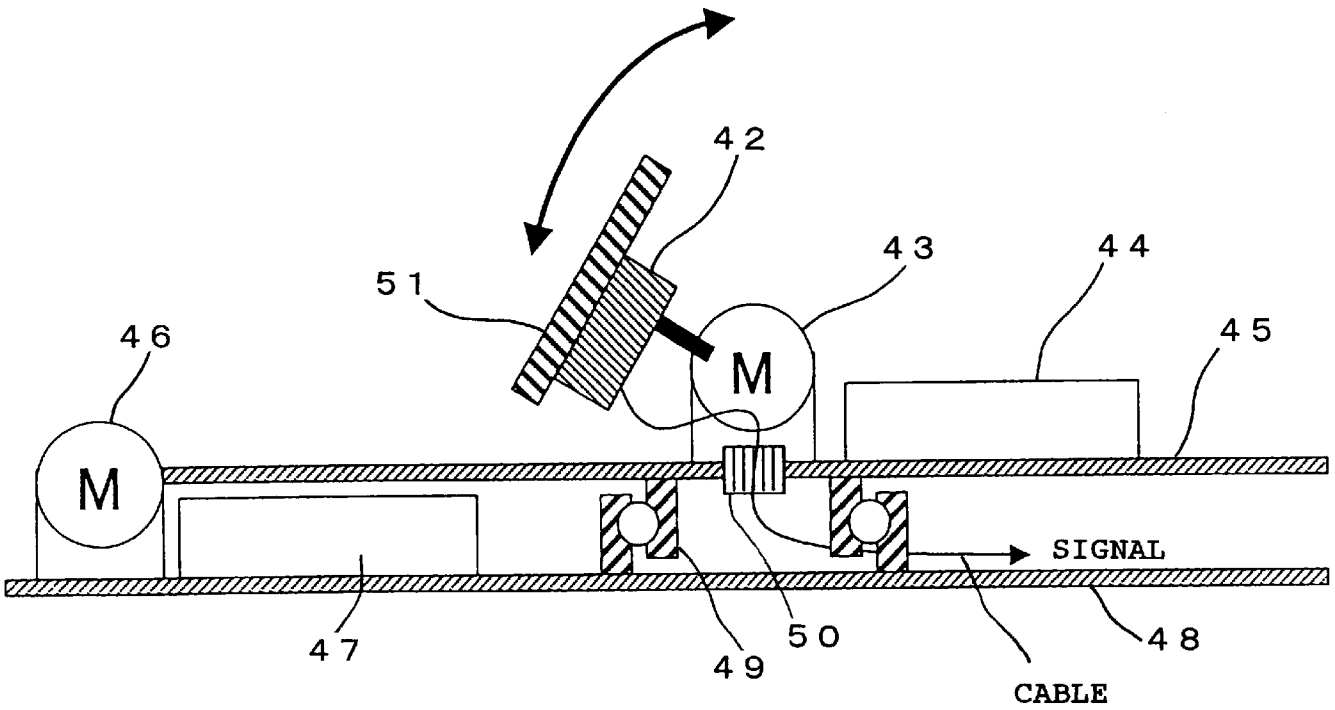
FIG. 5 is a schematic cross sectional view of the tracking antenna system of FIG. 4.

When using a conventional antenna device as an in-vehicle satellite tracking antenna, the arrangement shown in FIGS. 4 and 5, for example, can be employed. Specifically, as shown in the figures, a plane antenna 51 and a high frequency circuit 42 for electrically driving the same are arranged on a turn table 45 which is disposed on a base stand 48 in a freely rotatable manner via a bearing 49. The turn table 45 is driven for rotation by an azimuth tracking motor 46, whereby the plane antenna 51 functions to track the azimuth direction of an artificial satellite. on the other hand with respect to tracking of the elevation angle, an elevation angle tracking motor 43 and a driving circuit 44 for driving the same are arranged on the turn table 45, and the elevation angle of the plane antenna 51 and the high frequency circuit 42 is directly adjusted by the elevation angle tracking motor 43. The conventional antenna system has the construction mentioned above, and therefore electric power must be fed to electric circuits on the turn table 45 via a distribution cable, which requires arrangement of a rotary joint and a slip ring 50 on the turn table 45. In addition, a lot of component elements are mounted on the turn table 45, and hence the azimuth tracking motor 46 must be a relatively large one in order to drive the turn table 45 for rotation. To meet such requirements, conventional satellite tracking antenna systems are made wide and large in scale. Further, as these systems include expensive component elements, reduction in their cost has been very difficult to achieve.

To cope with this inconvenience, a tracking antenna system which is small in size with power saving function as well as low-profile and low in cost is desired.

Figure 13:
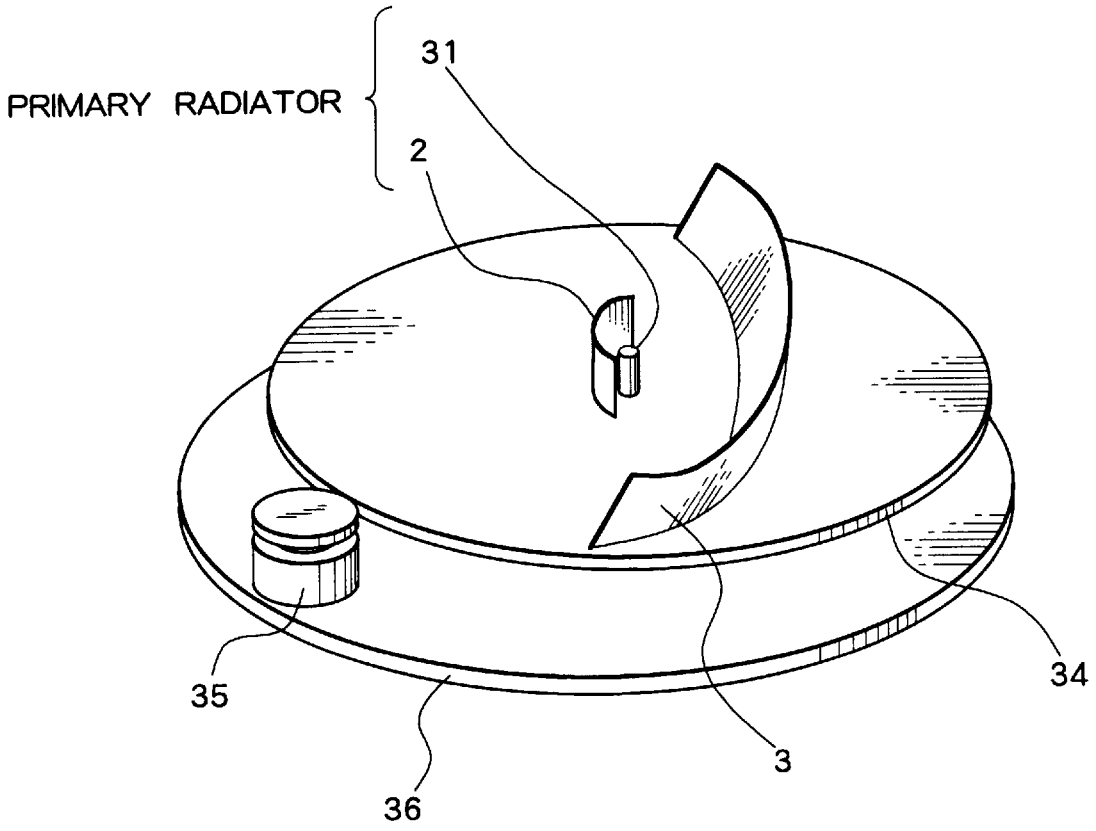
FIG. 13 is a perspective view schematically showing the construction of a tracking antenna system according to an Aspect 3 of the preferred embodiment of the present invention.
Figure 14:
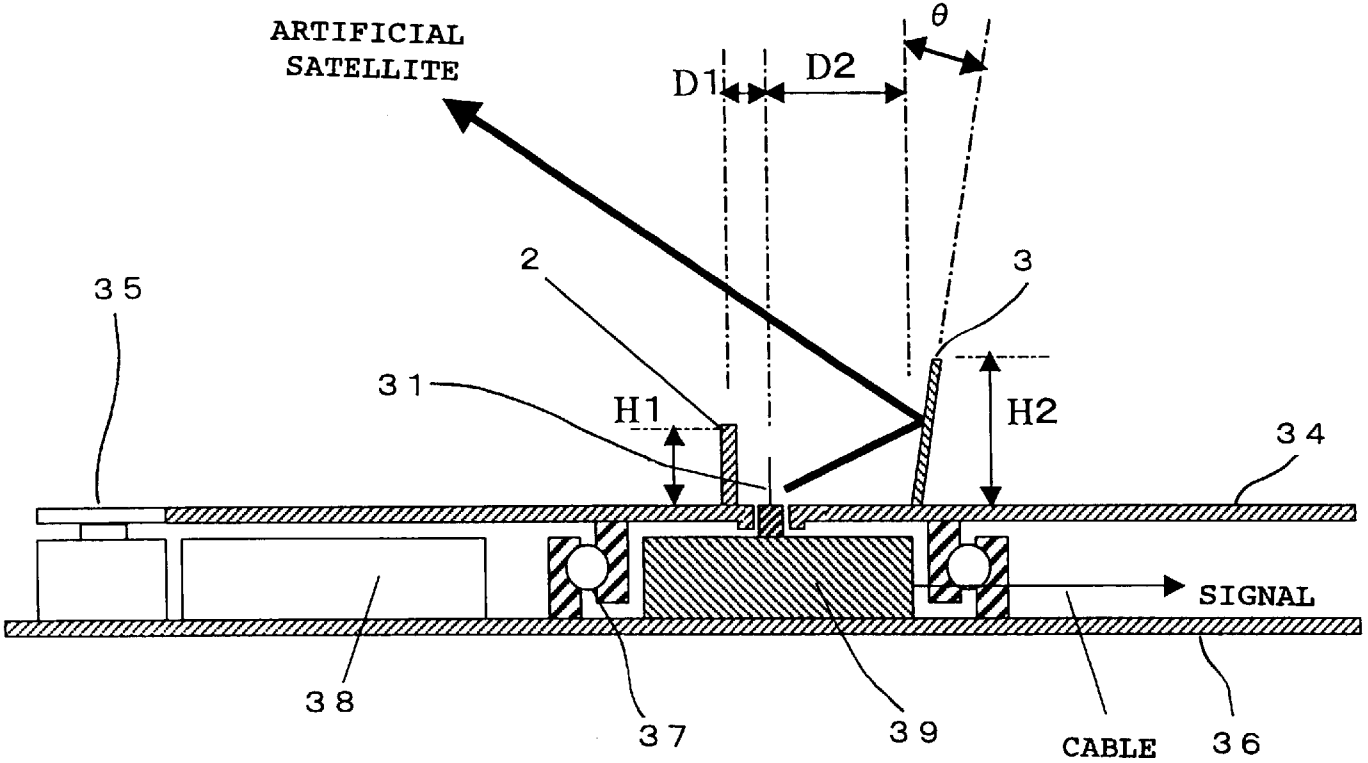
FIG. 14 is a schematic cross sectional view of the tracking antenna system of FIG. 13.

The tracking antenna system in Aspect 3 is proposed to realize the desire mentioned above, and constructed such that the antenna block of FIG. 6 is placed on a base stand and supported by the same in a rotatable manner. FIG. 13 shows the concept of the tracking antenna system, and FIG. 14 schematically shows the cross-sectional construction of the same.

As shown in the figures, a ground plate 34 forming the antenna block has an upper surface functioning as a reflection surface, on which are arranged the sub-reflector 2 and the main reflector 3, similarly to the antenna system in Aspect 1. A feed probe 31 is connected to a high frequency circuit 39 which is secured on a base stand 36. Further, the ground plate 34 has a hole into which is inserted the feed probe 31 from a lower surface of the ground plate 34 in a fashion being out of contact therewith, and the thus inserted feed probe 31 protrudes from the upper surface of the ground plate 34.

The ground plate 34 also functions as a turntable for rotating the antenna system in a desired azimuth, which is disposed on the base stand 36 in a freely rotatable manner around the feed probe 31 via a bearing 37. Further arranged on the base stand 36 is an azimuth tracking motor 35 which is positioned at a periphery of the disk-type ground plate 34 for transferring drive thereof to the periphery of the ground plate 34, to thereby drive the ground plate 34 for turn. The motor 35 is driven by means of an azimuth tracking motor driving circuit 38 which is also arranged on the base stand 36 and in a space defined by the base stand 36 and the ground plate 34.

Figure 15:
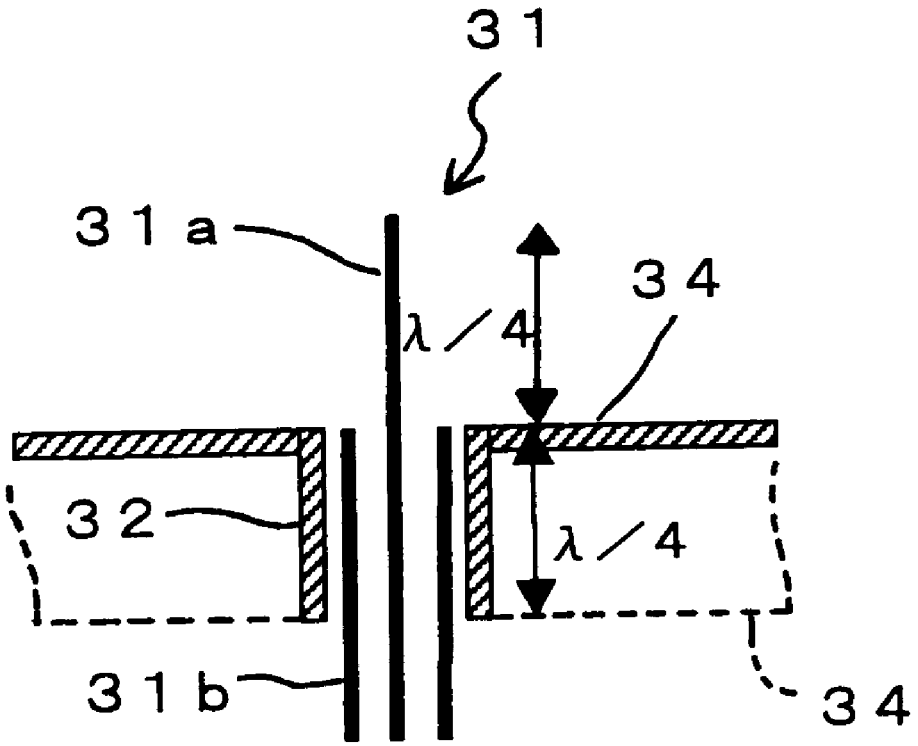
FIG. 15 is a cross sectional view showing the detailed construction of a feeding block of the tracking antenna system of FIG. 13.

FIG. 15 shows in detail the construction of the feeding block of the antenna system in Aspect 3. As is apparent from the figure, the feed probe 31 formed by a coaxial line is comprised of a central conductor 31*a* and an external conductor 31*b*. The central conductor 31a protrudes from the upper surface of the ground plate 34 by approximately ¼ the wavelength, and the external conductor 31*b* terminates at the upper surface of the ground plate 34. The hole formed in the ground plate 34 has a periphery thereof provided with a circular conductor member 32. The conductor member 32 is spaced away from the external conductor 31*b*, and extends from the upper surface of the ground plate 34 to the lower surface of the same by a length (height or depth) equal to ¼ the wavelength. The feed probe 31 is inserted into the hollow portion of the thus formed circular conductor member 32 in a fashion being out of contact therewith. By providing the circular conductor member 32, even if the feed probe 31 and the ground plate 34 are kept from contact with each other, radio waves can be prevented from leaking from a gap between the feed probe 31 and the circular conductor member 32 to the lower surface of the ground plate 34, whereby the same electric property as that obtained when the both members are made into contact with each other is obtained.

With respect to preventing radio wave leakage, a conductive inner surface of the hole formed in the ground plate 34 may extend from the upper surface to the lower surface by a length equal to about $\lambda/4$, instead of providing the circular conductor member 32. For example, when the thickness of the ground plate 34 is equal to or more than $\lambda/4$ as shown by the dotted line in FIG. 15, leaking of radio waves from the lower surface of the ground plate 34 can be prevented by the conductive inner surface of the hole extending from the upper surface to the lower surface. This conductive inner surface may be constructed by forming a conductive layer on the inner surface of the hole or by using the conductive material as the ground plate 34.

Further, in Aspect 3, because the ground plate 34 is kept from contact with the feed probe 31, the feed probe 31 is not rotated, even when the ground plate 34 is driven for rotation by the motor 35 in order to track the artificial satellite in the azimuth direction, and a rotary joint is not required between the feed probe 31 and the high frequency circuit 39. Still further, according to the tracking antenna system in Aspect 3, when the artificial satellite is tracked, tracking the satellite in the direction of the elevation angle is eliminated, because the height H2 of the main reflector 3 of the antenna is set to a relatively small value and the width of directional beams toward the artificial satellite is expanded in a plane at the elevation angle. As a result, an area or a space for driving the antenna in the direction of the elevation angle can be eliminated. Even further, a motor for tracking the elevation angle and a driving circuit for driving the same are dispensed with, and therefore only component elements which can be formed of metal, such as the sub-reflector 2 and the main reflector 3 are mounted on the ground plate 34 functioning as a turn table for tracking the azimuth. These reflectors are lightweight and, therefore, the motor 35 for driving the ground plate 34 can be downsized. In addition, motors, circuits such as a motor driving circuit, etc. which require electric power, need not be arranged on the ground plate 34, which then eliminates need for a slip ring.

According to the tracking antenna system in Aspect 3, the construction of the antenna block per se can be simplified, and the whole system is inexpensive and lightweight, leading to a lower-profile tracking antenna system which is very suitable for use in an in-vehicle satellite tracking antenna system.

In the above description, as shown in FIGS. 13 and 14, the main reflector 3 is of a belt-type parabolic cylinder having the predetermined focal line, in which the horizontal cross section thereof depicts a parabola and the vertical cross section thereof depicts a straight line, but this it not limiting. Alternatively, the main reflector 3 may be formed of a belt-type rotational parabolic cylinder (offset parabola) with the focal point at the location of the feed probe 31, as shown in FIG. 10. If the wave source of the primary radiator can be regarded as the point source, use of the main reflector 3 in FIG. 10 can lead to higher peak gain than that obtained by the parabolic cylindrical main reflector 3 shown in FIGS. 13 and 14.

With respect to the reflection surface, the entire upper surface of the ground plate 4 may be formed so as to function as the reflection surface with conductivity. In addition to this formation, the ground plate 4 may be formed, as shown in FIG. 7, such that the upper surface thereof includes the area surrounded by the sub-reflector 2 and the main reflector 3 facing the same, which area functions as the reflection surface for manifesting the effect of mirror image. To reduce scattering of radio waves due to the edge of the ground plate, however, the reflection surface of the ground plate should be larger. In the following aspects, the above two different types of reflection surfaces may be applicable to formation of the ground plate.

[Aspect 4]

Figure 16:
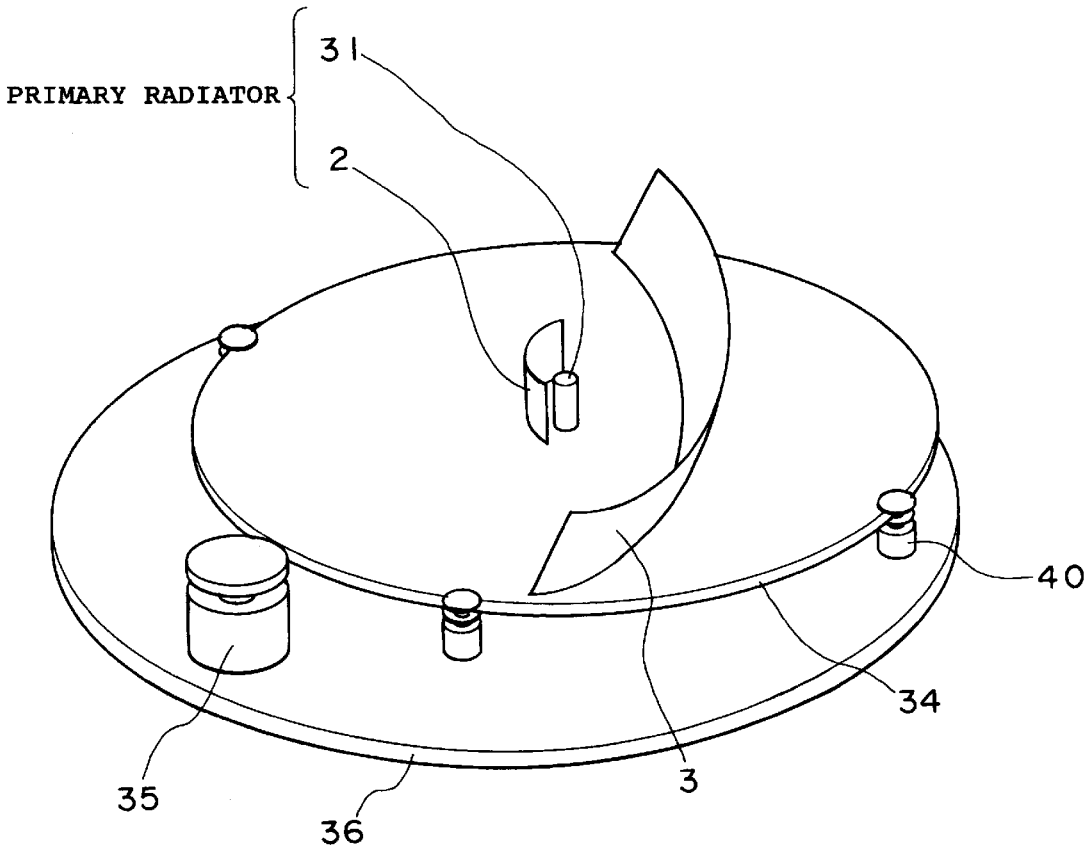
FIG. 16 is a perspective view schematically showing the construction of a tracking antenna system according to an Aspect 4 of the preferred embodiment of the present invention.
Figure 17:
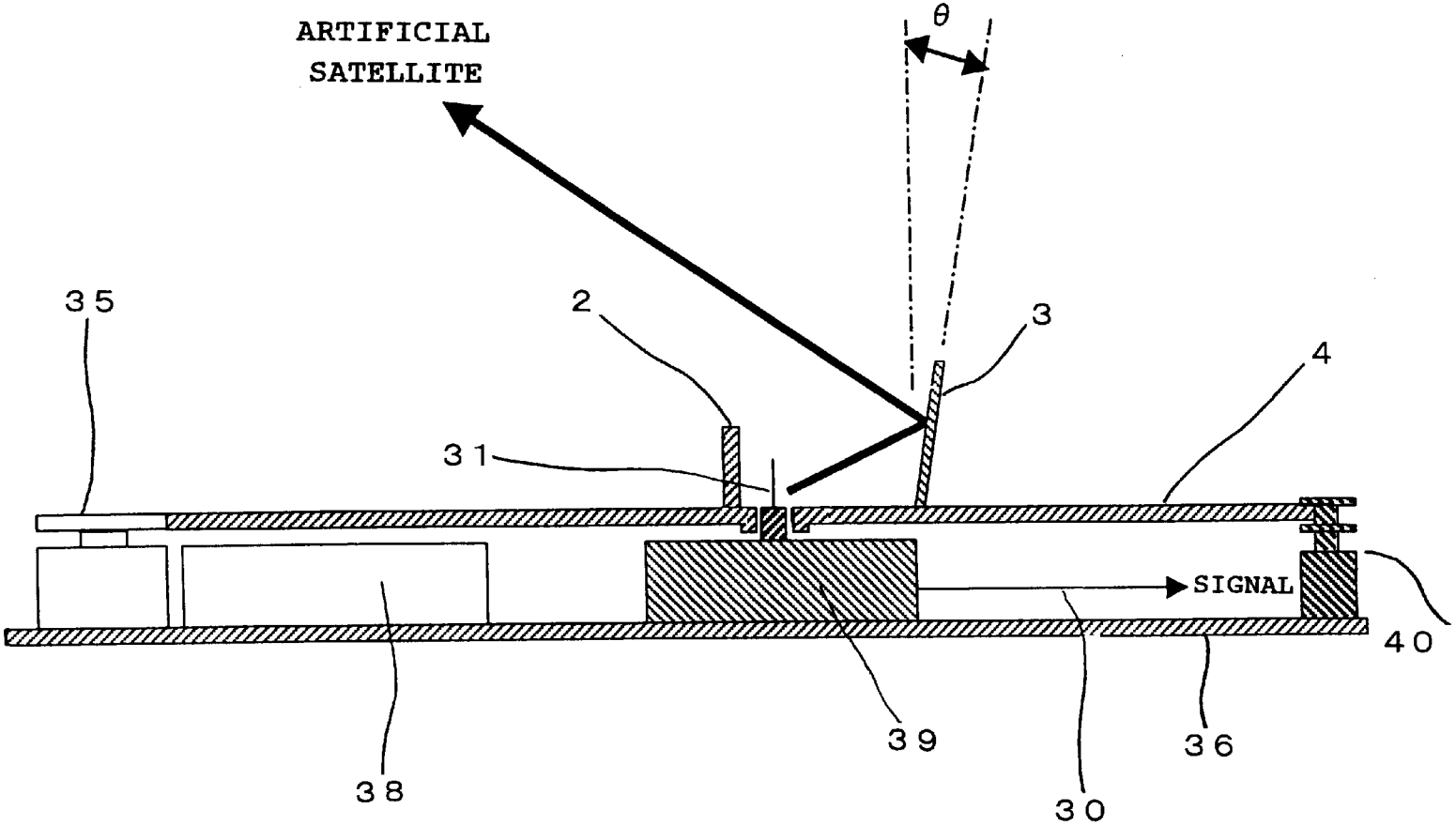
FIG. 17 is a schematic cross sectional view of the antenna system of FIG. 16.

FIGS. 16 and 17 show the construction of a tracking antenna system according to an Aspect 4 of the preferred embodiment of the present invention. The tracking antenna system in Aspect 4 is distinguished from Aspect 3 in a mechanism for driving azimuth tracking. Except for this, the antenna system in Aspect 4 is identical in construction and arrangement with that in Aspect 3, and description thereof is omitted. In Aspect 4, a plurality of (e.g. three) guides are arranged at the periphery of the ground plate 34, in place of the bearing 37 in FIG. 14, and the edge of the ground plate 34 is fitted into the guides 40, to thereby support the ground plate 34 on the base stand 36 in a rotatable manner. Driving of the ground plate 34 for rotation in the azimuth direction is carried out by the motor 35, similarly to Aspect 3.

The bearing 37 shown in FIG. 14 must be of a size such that the high frequency circuit 39 can be incorporated at the inner radius thereof, and therefore the bearing 37 must be considerably large. The large-sized bearing 37 of this type is expensive and difficult in slimming. In addition, provision of the bearing 37 limits the area of the base stand 36 on which a circuit substrate etc. are placed. Accordingly, the construction of the antenna system in Aspect 4, in which the bearing is omitted, realizes a satellite tracking antenna system which is less expensive and lower-profile.

[Aspect 5]

Figure 18:
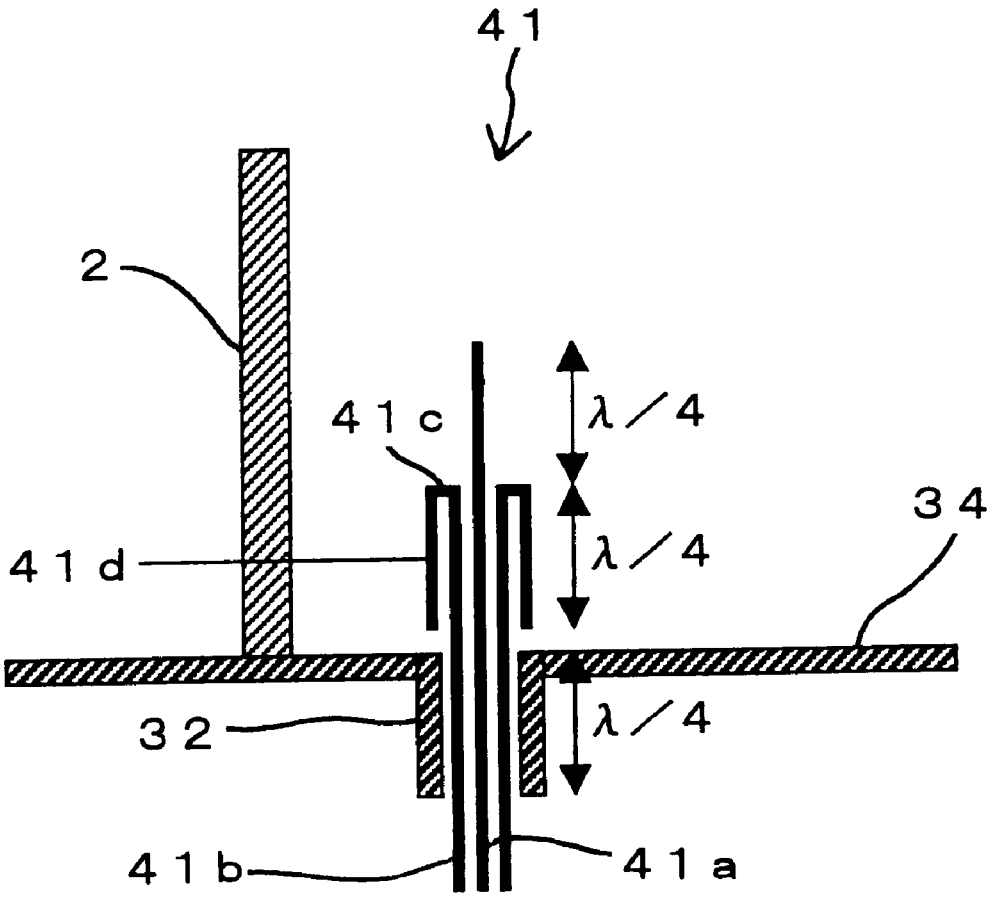
FIG. 18 is a cross sectional view schematically showing a primary radiator of a tracking antenna system according to an Aspect 5 of the preferred embodiment of the present invention.

FIG. 18 shows the construction of a primary radiator of a tracking antenna system according to an Aspect 5 of the invention.

In the antenna system in Aspect 5, a sleeve dipole antenna identical with in Aspect 2 is employed as the feed probe. Except for this, the construction and arrangement of the antenna system are the same in Aspect 3 or Aspect 4, description thereof being omitted. A coaxial line forming a sleeve dipole antenna element 41 is comprised of a central conductor 41*a* and an external conductor 41*b*, similarly to the feed probe 31 in FIG. 13 or FIG. 14. The coaxial line has an end, and a sleeve 41*d* of the external conductor 41*b* is folded by approximately ¼ the wavelength λ to be used, at the end, while a linear conductor extending from the central conductor 41*a* protrudes from the end by ¼ the wavelength λ to be used. The periphery of the hole formed in the ground plate 34 is provided with a circular conductor member 32, similarly to the case in Aspect 3. The conductor member 32 extends from the upper surface of the ground plate 34 to the lower surface of the same by the length (height or depth) equal to ¼ the wavelength. The sleeve dipole antenna element 41 is inserted into the hollow portion of the thus formed circular conductor member 32 in a fashion being out of contact therewith. By providing the circular conductor member 32, the ground plate 34 can be turned around the antenna element 41 being a rotational axis, and radio waves can be prevented from leaking to the lower surface of the ground plate 34. In addition, by providing the conductor member 32, the same electric property as that obtained when the both members are made into contact with each other is obtained.

According to the present aspect, by determining the sleeve dipole antenna element 41 (feed point 41*c*) at an appropriate position with respect to the ground plate 34 and the sub-reflector 2, matching of impedance can be obtained in a wide frequency band, similarly to the aspects described above. Further, by constructing the primary reflector as shown in FIG. 18, the effect of mirror image caused by the ground plate 34 can bring about the same characteristic as that obtained by a two-element linear array as the primary radiator, which leads to more enhanced directivity of the antenna system in the horizontal direction. As a result, the antenna system in the present aspect can reduce the height of the main reflector to a further extent compared to the height in Aspect 3 and Aspect 4, which is effective in slimming the entire antenna system.

While there has been described what are at present considered to be preferred embodiments of the invention, it will be understood that various modifications may be made thereto, and it is intended that the appended claims cover all such modifications as fall within the true sprit and scope of the invention.

What is claimed is:

1. An antenna system comprising:

a ground plate having an upper surface;

a feed probe located on said ground plate no as to protrude from said upper surface of said ground plate;

a sub-reflector standing on said upper surface of said ground plate in the vicinity of said feed probe; and a main reflector having a mirror surface which has one of a predetermined focal point and a predetermined focal line, and standing on said upper surface of said ground plate such that said mirror surface of said main reflector and a mirror surface of said sub-reflector face each other across said feed probe, said one of a focal point and focal line being determined so as to correspond to a location of said feed probe.

2. An antenna system according to claim 1, wherein said feed probe comprises a sleeve dipole antenna element formed by a coaxial line comprising a central conductor and an external conductor, said external conductor having a sleeve folded back to overlap said external conductor by a length equal to approximately ¼ a wavelength so as to form an end of said coaxial line, and said central conductor having a linear conductor extending therefrom by a length equal to approximately ¼ said wavelength away from said end.

3. An antenna system according to claim 1, wherein said main reflector stands on said upper surface of said ground plate at an installing angle depending on an elevation angle of a satellite, and in a direction configured to receive or radiate radio waves.

4. An antenna system according to claim 1, wherein said upper surface of said ground plate includes an area substantially surrounded by said mirror surface of said sub-reflector and said mirror surface of said main reflector facing said mirror surface of said sub-reflector, and at least said area on said upper surface functions as a reflection surface that manifests a mirror image effect.

5. An antenna system comprising:

a plane ground plate having an upper surface, a lower surface, and a hole;

a feed probe inserted into said ground plate from said lower surface through said hole so as to protrude from said upper surface of said ground plate without contacting said ground plate;

a sub-reflector standing on said upper surface of said ground plate in the vicinity of said feed probe protruding from said upper surface of said ground plate; and a main reflector having a mirror surface which has one of a predetermined focal point and a predetermined focal line, and standing on said upper surface such that said mirror surface of said main reflector and a mirror surface of said sub-reflector face each other across said feed probe, said one of a focal point and focal line being determined so as to correspond to a location of said feed probe.

6. An antenna system according to claim 5, wherein an azimuth of said antenna system is directed in a direction configured to receive or radiate radio waves by turning said ground plate around said feed probe, being a rotational axis, without contacting said feed probe.

7. An antenna system according to claim 5, wherein said feed probe comprises a sleeve dipole antenna element formed by a coaxial line comprising a central conductor and an external conductor, said external conductor having a sleeve folded back to overlap said external conductor by a length equal to approximately ¼ a wavelength so as to form an end of said coaxial line, and said central conductor having a linear conductor extending therefrom by a length equal to approximately ¼ said wavelength away from said end.

8. An antenna system according to claim 5, wherein said main reflector stands on said upper surface of said ground plate at an installing angle depending on an elevation angle of a satellite, and in a direction configured to receive or radiate radio waves.

9. An antenna system according to claim 5, wherein at least a periphery area around said hole in said upper surface is conductive, and an inner surface area of said hole extending from said upper surface to said lower surface by a length equal to approximately ¼ a wavelength is conductive.

10. An antenna system according to claim 9, wherein said feed probe comprises a sleeve dipole antenna element formed by a coaxial line comprising a central conductor and an external conductor, said external conductor having a sleeve folded back to overlap said external conductor by a length equal to approximately ¼ a wavelength so as to form an end of said coaxial line, and said central conductor having a linear conductor extending therefrom by a length equal to approximately ¼ said wavelength away from said end.

11. An antenna system according to claim 9, wherein said main reflector stands on said upper surface of said ground plate at an installing angle depending on an elevation angle of a satellite, and in a direction configured to receive or radiate radio waves.

12. An antenna system according to claim 5, wherein said ground plate forms a turntable which is disposed on a base stand via a bearing in a rotatable manner, said ground plate turns around said feed probe, being a rotational axis, by transferring rotation of a motor arranged on said base stand to a periphery of said ground plate.

13. An antenna system according to claim 12, wherein at least a periphery area around said hole in said upper surface is conductive, and an inner surface area of said hole extending from said upper surface to said lower surface by a length equal to approximately ¼ a wavelength is conductive.

14. An antenna system according to claim 12, wherein said ground plate is disk shaped.

15. An antenna system according to claim 5, wherein said ground plate is disk shaped and turns around said feed probe, being a rotational axis, a periphery of said ground plate being supported by guides in a rotatable manner, and a motor arranged on a base stand transferring rotation to said periphery of said ground plate.

16. An antenna system according to claim 15, wherein at least a periphery area around said hole in said upper surface is conductive, and an inner surface area of said hole extending from said upper surface to said lower surface by a length equal to approximately ¼ a wavelength is conductive.

17. An antenna system according to claim 6, wherein said feed probe comprises a sleeve dipole antenna element formed by a coaxial line comprising a central conductor and an external conductor, said external conductor having a sleeve folded back to overlap said external conductor by a length equal to approximately ¼ a wavelength so as to form an end of said coaxial line, and said central conductor having a linear conductor extending there from by a length equal to approximately ¼ said wavelength away from said end.

18. An antenna system according to claim 6, wherein said main reflector stands on said upper surface of said ground plate at an installing angle depending on an elevation angle of a satellite, and in a direction configured to receive or radiate radio waves.

19. An antenna system according to claim 6, wherein at least a periphery area around said hole in said upper surface is conductive, and an inner surface area of said hole extending from said upper surface to said lower surface by a length equal to approximately ¼ a wavelength is conductive.

20. An antenna system according to claim 5, wherein said upper surface of said ground plate includes an area su surrounded by said mirror surface of said sub-reflector and said mirror surface of said main reflector facing said mirror surface of said sub-reflector, and at least said area on said upper surface functions as said reflection surface that manifests a mirror image effect.

21. An antenna system according to claim 5, wherein a periphery of said hole formed in said ground plate is provided with a circular conductor member extending from said upper surface to said lower surface by a length equal to approximately ¼ a wavelength, said circular conductor member having a hollow portion formed therein, and said feed probe is inserted into said hollow portion.

* * * * *